US006971610B2

(12) United States Patent
Hein et al.

(10) Patent No.: US 6,971,610 B2
(45) Date of Patent: Dec. 6, 2005

(54) RAILWAY DIAMOND WEDGE CROSSING WITH REVERSIBLE BEAM CASTINGS

(75) Inventors: Russell R. Hein, Denison, TX (US); Robert C. Roberts, Jr., Talladega, AL (US); Brian Weaver, Burlington, KY (US)

(73) Assignee: General Electric Capital Corporation, Chicago, IL (US)

( * ) Notice: Subject to any disclaimer, the term of this patent is extended or adjusted under 35 U.S.C. 154(b) by 88 days.

(21) Appl. No.: 10/662,787

(22) Filed: Sep. 15, 2003

(65) Prior Publication Data

US 2005/0056732 A1 Mar. 17, 2005

(51) Int. Cl.[7] ..... E01B 7/00
(52) U.S. Cl. ..... 246/465; 246/454
(58) Field of Search ..... 246/465, 454, 246/466, 467, 453, 455, 456, 463, 464, 462, 472; 238/336, 354, 338, 361, 341, 362, 353, 363, 364, 365, 349, 351

(56) References Cited

U.S. PATENT DOCUMENTS

| | | | | | |
|---|---|---|---|---|---|
| 69,814 | A | * | 10/1867 | Jones | 246/465 |
| 374,265 | A | * | 12/1887 | Moxham | 246/466 |
| 500,706 | A | * | 7/1893 | Elliott | 246/466 |
| 908,351 | A | * | 12/1908 | Strickland | 246/463 |
| 979,479 | A | | 12/1910 | Elfborg | |
| 1,225,421 | A | * | 5/1917 | Elfborg | 246/463 |
| 1,632,725 | A | * | 6/1927 | Brown | 246/463 |
| 1,743,924 | A | * | 1/1930 | Kopp | 246/465 |
| 2,539,529 | A | * | 1/1951 | Asselin | 246/467 |
| 4,770,342 | A | * | 9/1988 | Farrell et al. | 238/347 |
| 5,797,565 | A | * | 8/1998 | Tuningley et al. | 246/465 |

* cited by examiner

*Primary Examiner*—Mark T. Le
(74) *Attorney, Agent, or Firm*—Bracewell & Patterson, L.L.P.; James E. Bradley

(57) ABSTRACT

A railway crossing has a plate with a pocket that defines a crossing angle for enabling one railway line to cross over another at virtually any angle. The pocket closely receives continuous long beams and divided beams. The pocket also has protrusions for restricting longitudinal horizontal movement of the beams. Each divided beam has three separate, discontinuous segments, including two outer segments and one inner segment. The segments are reversible such that the inner segments may be interchangeably positioned with each other, and the outer segments may be interchangeably positioned with each other. Fasteners secure the beams to the plate and resist both vertical movement and lateral horizontal movement. Each fastener has a wedge brace, a clip, and a wedge. The wedge prevents pull-apart of the plate and the beams due to thermal forces, mechanical forces, and surface discontinuities.

10 Claims, 9 Drawing Sheets

RAILWAY DIAMOND WEDGE CROSSING WITH REVERSIBLE BEAM CASTINGS

BACKGROUND OF THE INVENTION

1. Technical Field

The present invention relates in general to an improved railway crossing and, in particular, to an improved railway diamond crossing with reversible beam castings.

2. Description of the Prior Art

Railway crossings, generally referred to as diamond crossings, occur where one railway line crosses over another. At the present time most railway crossings have to be individually designed because the crossing angles vary from one crossing to another. It has been found that, in general, very few crossings have the same crossing angle. This means that each and every crossing has to be custom designed and custom made. Railway crossings wear faster than continuous railway lines due to train wheels impacting at the crossing points. This generally results in the crossings having to be replaced or repaired frequently. As these crossings are custom designed, in other words are non-standard, then the costs of replacing or repairing crossing members are high.

Attempts have been made to make standard railway crossings. One example is shown in U.S. Pat. No. 1,743,924 to Kopp. This patent shows solid rail sections, each one rectangular in cross-section with flangeway grooves therein and cutouts where two top rail members intersect with two bottom rail members. The rail members are attached to a single base plate and, as can be appreciated, the size of the plate is large and shipping a plate of this size to a site would be difficult. Moreover, a large plate does not provide access to railway ties, so one is not able to get underneath the plate to provide the necessary compaction to support the crossing. Furthermore, Kopp shows the rail sections being attached to railroad ties by spikes that engage a bottom flange of the rail section, and pass through holes provided in the base plate. Thus, if the spikes become loose, the rail sections tend to separate from this base plate, which can result in excessive movement causing wear and tear.

Another attempt to improved railway crossings is disclosed in U.S. Pat. No. 5,797,565 to Tuningley. In this patent, the railway crossing has four substantially identical crossing beams that have cutouts for a range of crossing angles. At least two separate base plates are cut to fit the required crossing angle and are positioned beneath the crossing beams. Each crossing beam has a flangeway groove extending along a portion of the beam length and each beam has integral rail shaped ends for connection to a standard rail section. The crossing beams have top cutouts and bottom cutouts that intersect and are set for a predetermined crossing angle. In addition, boltless locator pins are required to prevent horizontal movement of the top and bottom beams on the plates. Elastic fasteners hold the top and bottom beams to the plates to restrict vertical movement between the top and bottom beams and the plates. Although each of these prior art designs is workable, an improved railway crossing would be desirable.

SUMMARY OF THE INVENTION

One embodiment of a railway crossing constructed in accordance with present invention comprises a plate with a pocket that defines a crossing angle. The pocket has a plurality of protrusions formed therein. A plurality of continuous long beams and divided beams are mounted in the pocket. Each divided beam has three separate, discontinuous segments. In one version, the segments comprise two outer segments and one inner segment. The segments are aligned with each other but positioned at the crossing angle with respect to the long beams. The segments are reversible such that the inner segments may be interchangeably positioned or flip-flopped, and the outer segments are reversible such that the outer segments of one of the divided beams may be interchangeably positioned with the outer segments of either one of the divided beams.

At least one recess is formed in each of the long beams and in each of the segments of the divided beams. The recesses are complementary in shape to the shape of the protrusions in the pocket of the plate. Engagement of the recesses by the protrusions resists movement of the long and divided beams along their lengths with respect to the plate. The railway crossing also utilizes fasteners to secure the beams to the plate and resist both vertical movement and lateral horizontal movement. Each of the fasteners comprises a rail brace assembly having a wedge brace, a clip, and a wedge that is mounted between the wedge brace, the clip, and one of either the long beams or the divided beams. The wedge prevents pull-apart of the plate and the beams due to thermal forces, mechanical forces, and/or surface discontinuities. The railway crossing enables one railway line to cross over another at virtually any angle.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features and advantages of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
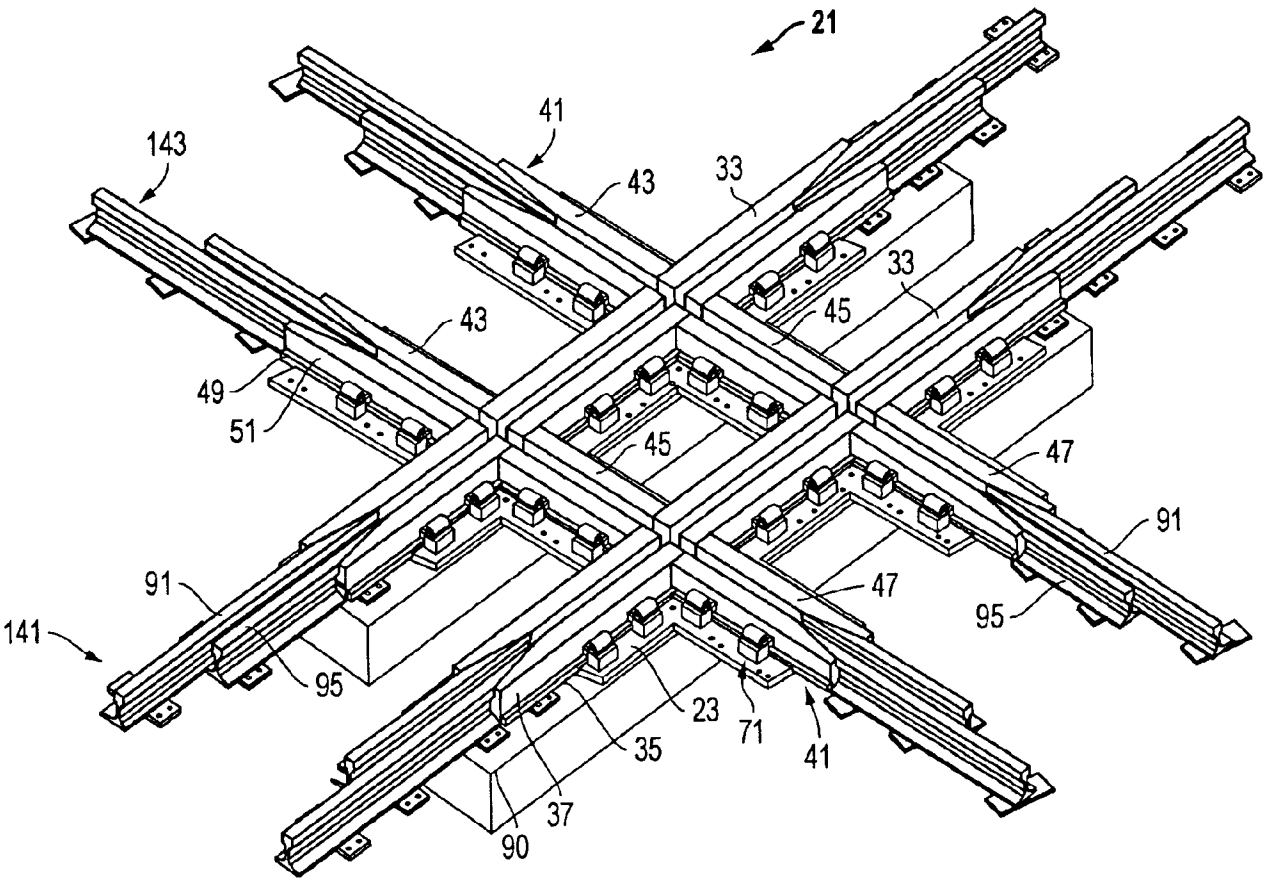
FIG. 1 is an isometric view of one embodiment of a railway crossing constructed in accordance with the present invention.
Figure 2:
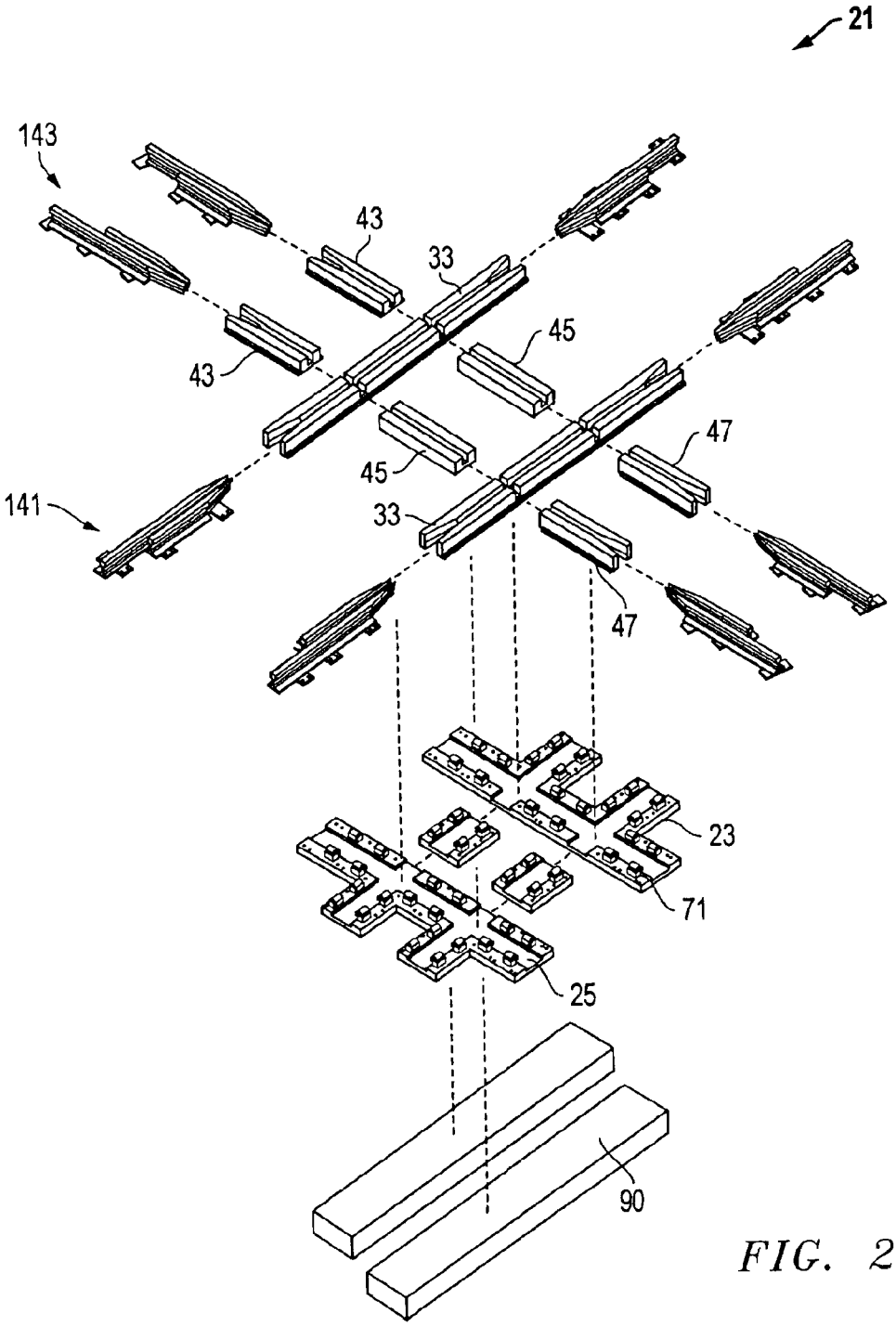
FIG. 2 is an exploded isometric view of the railway crossing of FIG. 1.
Figure 3:
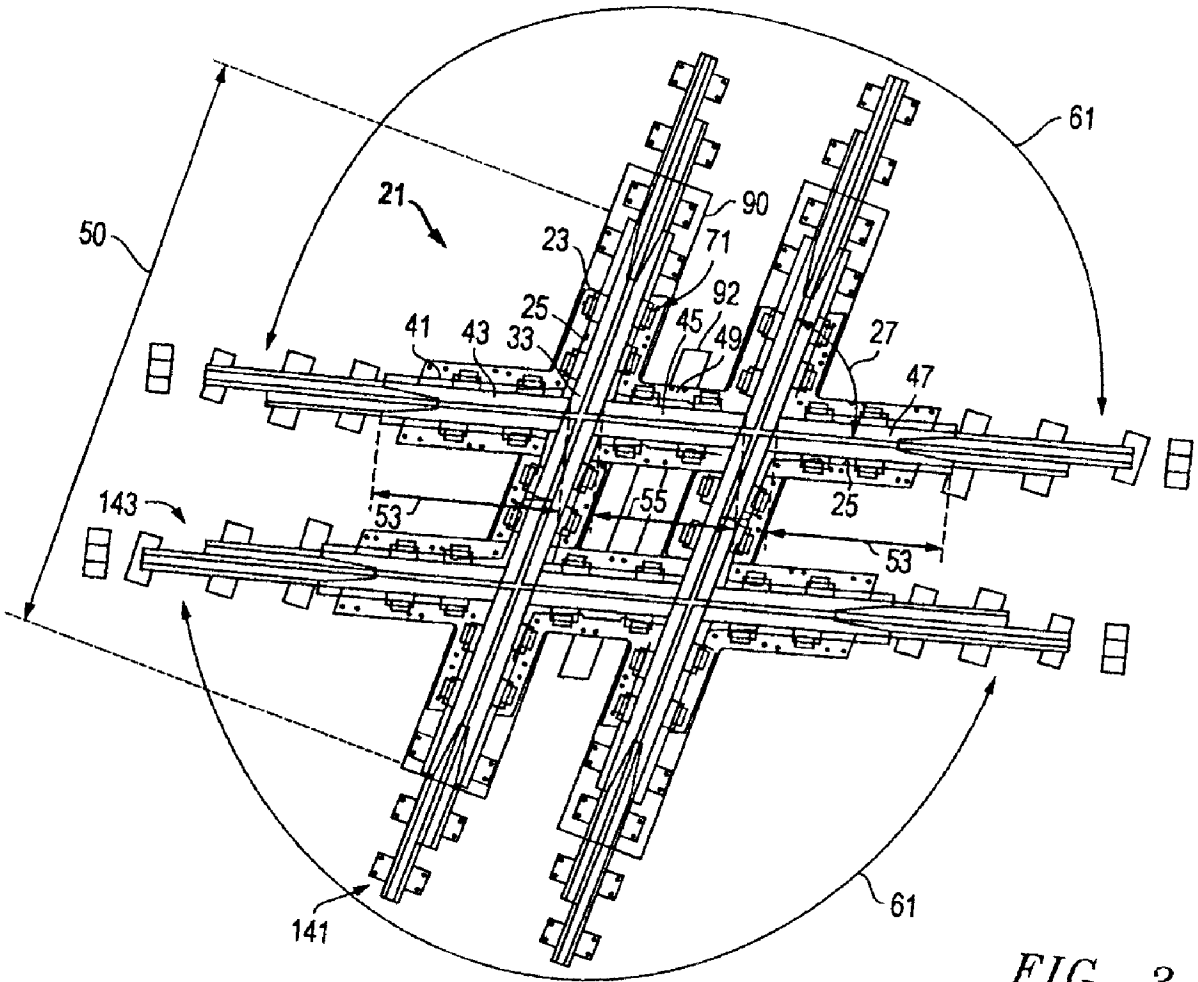
FIG. 3 is a top plan view of the railway crossing of FIG. 1.

Referring to FIGS. 1–3, a railway crossing 21 constructed in accordance with present invention is disclosed. The railway crossing 21 comprises a plate 23 having at least one plate segment. In one embodiment, the plate 23 comprises a plurality of plate segments. The number of plate segments may range, for example, from two to four pieces (FIG. 2) depending on the application, in order to facilitate easier handling of the plate 23 during installation. A pocket 25 (FIG. 6) is formed in the plate 23 and/or plate segments and defines a crossing angle 27. In one embodiment, the crossing angle 27 (FIG. 3) is in the range of 40 degrees to 90 degrees. The pocket 25 in the plate 23 has a plurality of protrusions 31 (FIG. 4) formed therein. The protrusions 31 may comprise many different shapes and sizes, but are shown with a generally scalloped profile.

Figure 6:
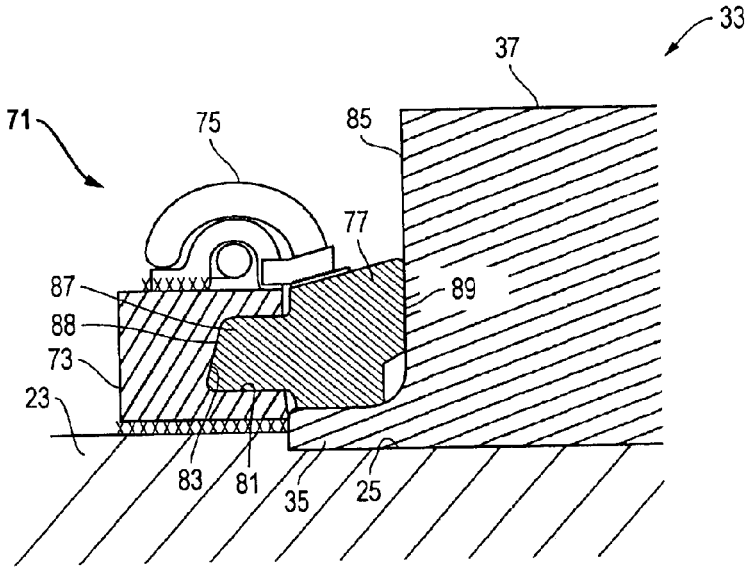
FIG. 6 is a sectional end view of a fastener installed on the railway crossing of FIG. 1.
Figure 7:
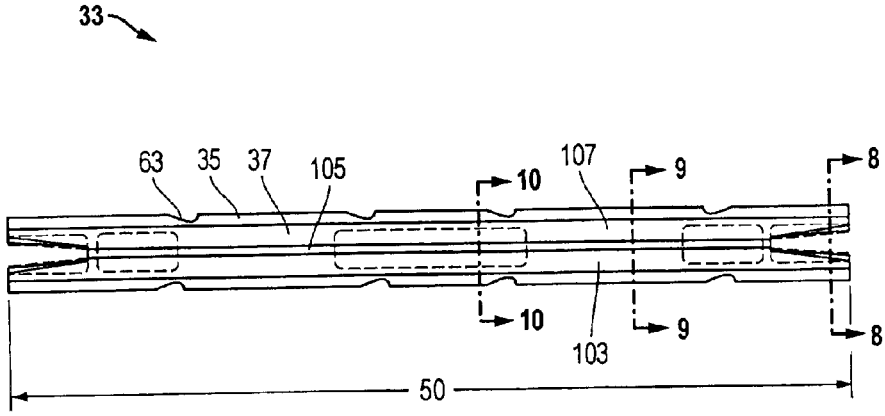
FIG. 7 is a top plan view of a long beam of the railway crossing of FIG. 1.
Figure 8:
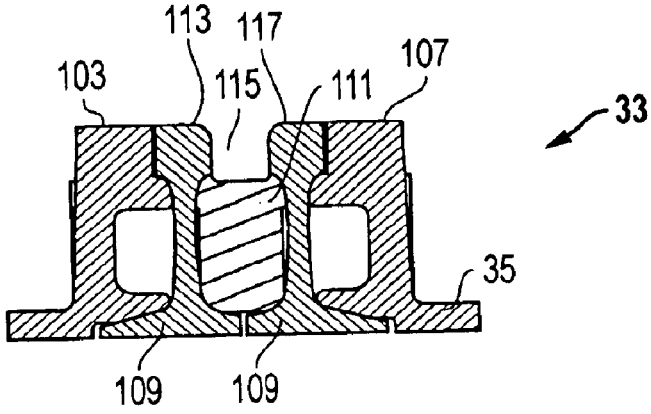
FIG. 8 is a sectional end view of the long beam of FIG. 7 taken along the lines 8—8 of FIG. 7.
Figure 9:
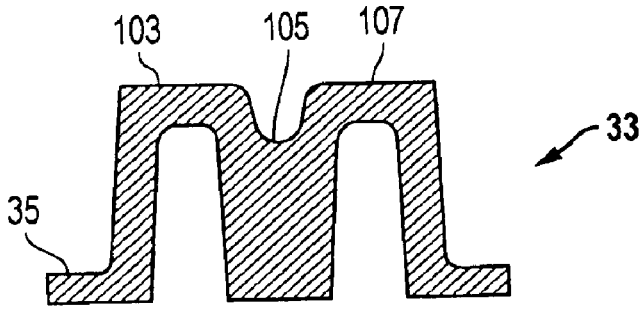
FIG. 9 is a sectional end view of the long beam of FIG. 7 taken along the lines 9—9 of FIG. 7.
Figure 10:
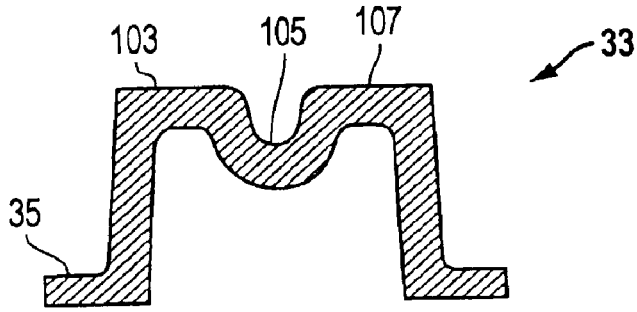
FIG. 10 is a sectional end view of the long beam of FIG. 7 taken along the lines 10—10 of FIG. 7.

The railway crossing 21 also comprises a plurality of castings including a pair of continuous long beams 33 (also see FIG. 7). As shown in FIG. 6, each long beam 33 has a flanged base 35 and a rail portion 37. The base 35 seats in and is closely received by the pocket 25 of the plate 23. In addition, the railway crossing 21 utilizes a pair of divided beams 41 (FIG. 1). Each divided beam 41 has three separate, discontinuous segments 43, 45, 47. Each of the segments 43 and 47, and 45 of the divided beams 41 has a longitudinal length 53, 55, respectively (FIG. 3), that is shorter than a longitudinal length 50 of the long beams 33. Each of the segments 43, 45, 47 also has a flanged base 49 and a rail portion 51. The bases 49 seat in the pocket 25 in the plate 23 (see FIG. 6 for comparison) in the same way that the long beams 33 seat in the pocket 25. The segments 43, 45, 47 are positioned at the crossing angle 27 with respect to the long beams 33 such that each of the segments 43, 45, 47 abuts at least one of the long beams 33.

Figure 4:
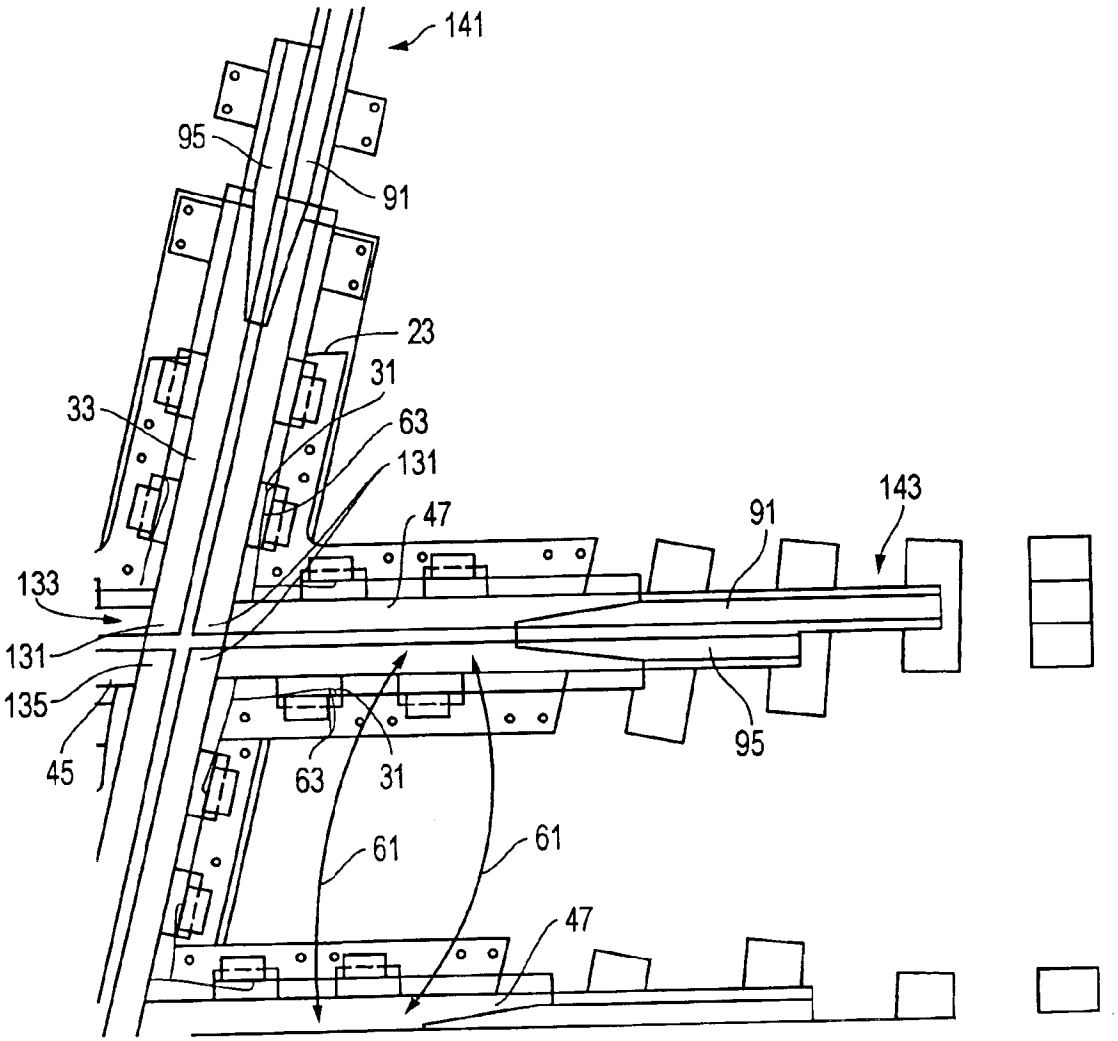
FIG. 4 is a top plan view of a portion of the railway crossing of FIG. 1.
Figure 5:
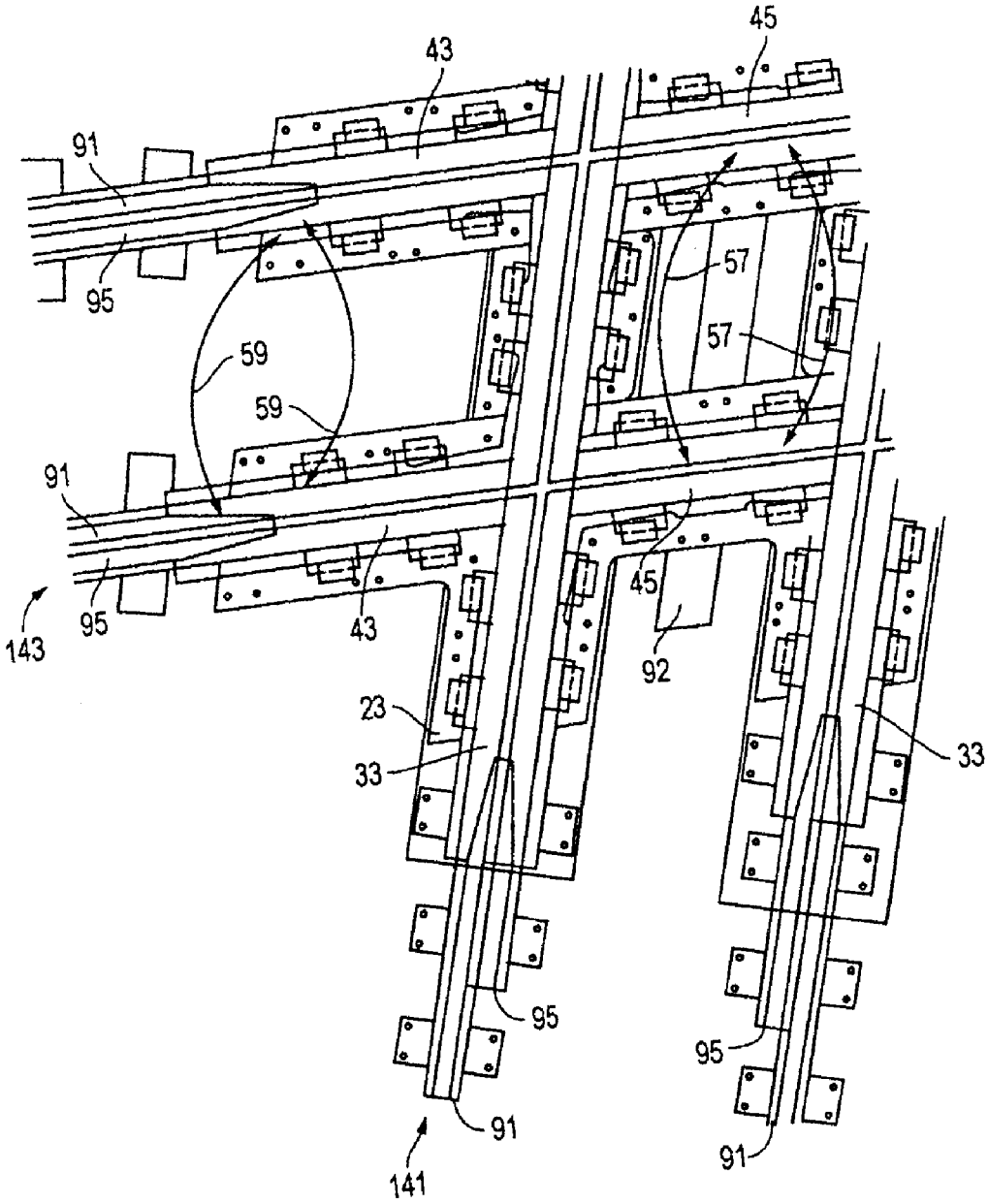
FIG. 5 is a top plan view of another portion of the railway crossing of FIG. 1.

In one embodiment, the segments 43, 45, 47 of each of the divided beams 41 comprise a pair of outer segments 43, 47 located outside of the long beams 33 and in abutment with one of the long beams 33, and an inner segment 45 located between the long beams 33 and in abutment with both of the long beams 33. The inner segment 45 has a longitudinal length 55 that is shorter than a longitudinal length 53 of either of the outer segments 43, 47. In this version of the present invention, the outer segments 43, 47 have equal lengths 53. In addition, the inner segments 45 are reversible such that the inner segment 45 of one of the divided beams 41 may be interchangeably positioned or flip-flopped with the inner segment 45 of the other of the divided beams 41, as indicated by arrows 57 (FIG. 5). Similarly, the outer segments 43, 47 are reversible such that the outer segments 43, 47 of one of the divided beams 41 may be interchangeably positioned with any of the outer segments 43, 47 of either one of the divided beams 41, as indicated by arrows 59, 61 (FIGS. 3–5).

At least one recess 63 (FIGS. 4 and 7) is formed in each of the bases 35 of the long beams 33 and in each of the bases 49 of the segments 43, 45, 47 of the divided beams 41. The recesses 63 are complementary in shape (scalloped, in the version illustrated) to the shape of the protrusions 31 in the pocket 25 of the plate 23. Although all of the recesses 63 are illustrated as having the same shape, their shapes may vary throughout the entire railway crossing 21. Engagement of the recesses 63 by the protrusions 31 resists movement of the long and divided beams 33, 41 along the longitudinal lengths 50, and 53 and 55, respectively (FIGS. 1 and 6), thereof with respect to the plate 23.

Another component of railway crossing 21 is the fasteners 71 (FIGS. 1, 2, and 6) that are used to secure the long beams 33 and the divided beams 41 to the plate 23. The fasteners 71 resist both vertical movement and lateral horizontal movement (transverse to lengths 50, 53, 55) of the long and divided beams 33, 41, respectively, with respect to the plate 23. In one embodiment, each of the fasteners 71 comprises a rail brace assembly having a wedge brace 73 (FIG. 6) that is joined or welded to the plate 23, a clip 75 that is joined or welded to the wedge brace 73, and a wedge 77 that is mounted between the wedge brace 73, the clip 75, and one of either the long beams 33 or the divided beams 41.

Alternatively, a holder is used for the clip 75 and either welded to or cast integrally to the weld brace 73. The clip 75 is generally a spring material, such that when it is driven into the holder, a load is applied to the top of the wedge 77. As shown in FIG. 6, a serrated cover washer may be used to fit between the wedge 77 and the clip 75 with the load of the clip 75 mainly holding the two serrated parts together so that the wedge 77 will not move longitudinally and become disengaged. These elements work together to prevent pull-apart of the plate 23, the long beams 33, and the divided beams 41 due to thermal forces, mechanical forces, and/or surface discontinuities, such as conditions in the track where the plate 23 and the crossing 21 may be suspended over the ties 90 due to settlement.

In one embodiment, the wedge brace 73 has a receptacle 81 (FIG. 6) formed therein with a tapered surface 83. Each of the long beams 33 and the segments 43, 45, 47 of the divided beams 41 has a tapered side wall 85. The wedge 77 has a contoured knob 87 that is complementary in shape to the receptacle 81, including a tapered surface 88 that engages tapered surface 83. The wedge 77 also has a tapered surface 89 opposite the tapered knob 87 that is complementary in shape to the tapered side walls 85 of the long and divided beams 33, 41 for engagement therewith.

Figure 11:
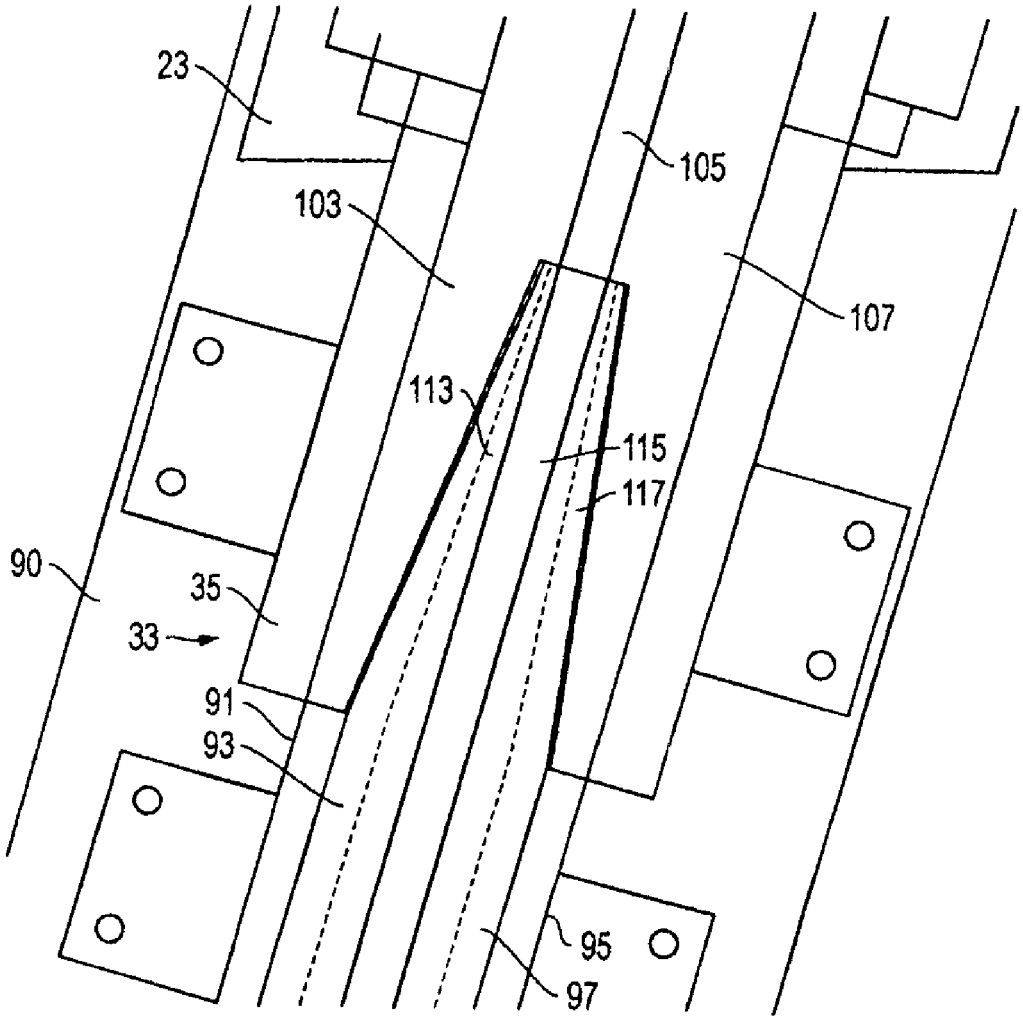
FIG. 11 is an enlarged, top plan view of one rail intersection of the railway crossing of FIG. 1.

In operation, railway crossing 21 enables one railway line 141 (FIGS. 1–3) to cross over another railway line 143 at virtually any angle. The railway crossing 21 is constructed on top of a plurality of railroad ties 90, 92. The outer end of each long beam 33 and each outer segment 43, 47 is designed to register and mate up with a standard rail 91 (FIGS. 1 and 11) having a running surface 93, and a relatively short segment of a guard rail 95 having a guard surface 97, as will be described in the following paragraph.

Figure 12:
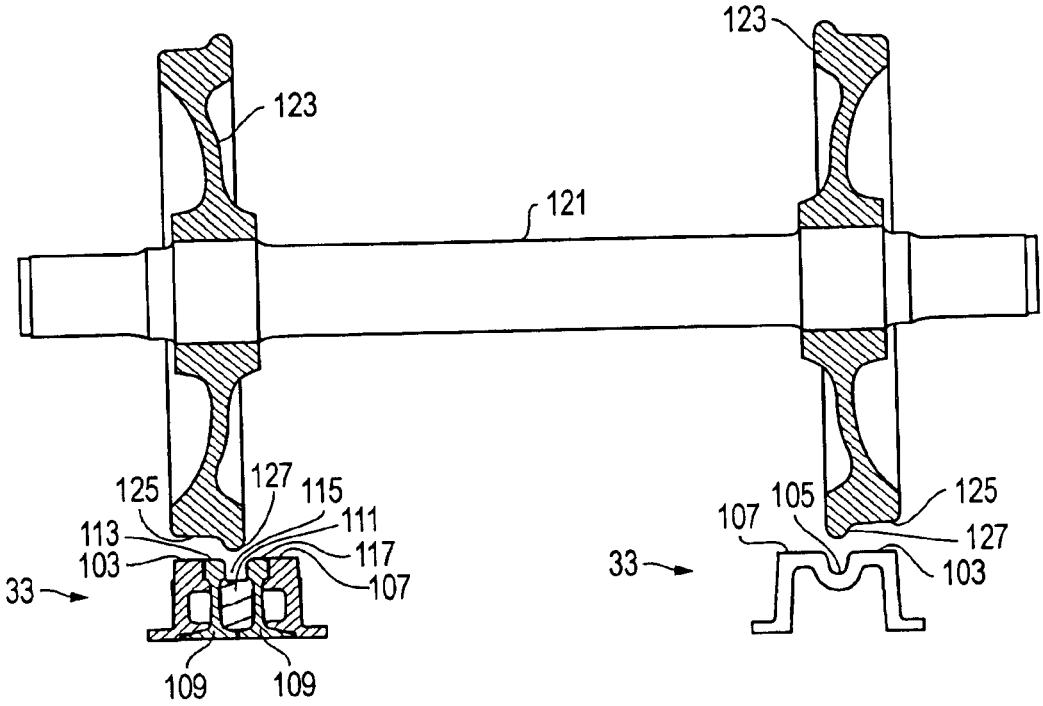
FIG. 12 is a partially exploded, sectional end view of one axle and set of wheels of a rail car and the railway crossing of FIG. 1 showing, on the left, the end view of FIG. 8 and, on the right, the end view of FIG. 10.
Figure 13:
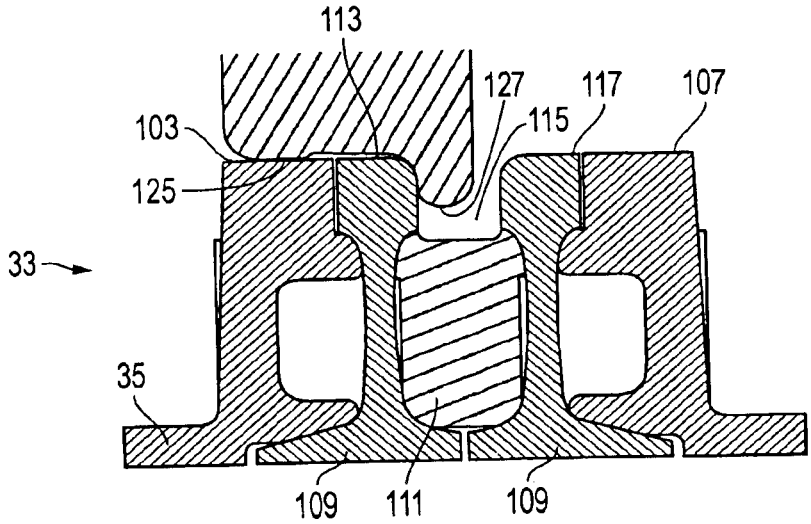
FIG. 13 is a sectional end view of one the wheels of the rail car on the railway crossing of FIG. 12.

For example and illustration purposes, the cross-sectional configurations and design of the tapered outer end of the long beam 33 is shown in FIGS. 8–11. However, the same design applies to all of the outer segments 43, 47 as well. Each outer end utilizes a running surface 103, a guard surface 107 (and a groove 105 therebetween) to match up with the running and guard surfaces 93, 97 of standard rail 91 and guard rail 95, respectively. In one embodiment, each tapered outer end comprises a pair of tapered rails 109 (FIGS. 12 and 13) and a tapered wedge block 111 therebetween. The running and guard surfaces 113, 117 of the tapered rails 109 taper smoothly to transition the standard rails 91 to railway crossing 21. The tapered rails 109 and the tapered wedge block 111 define a groove 115 that aligns with groove 105 of long beam 33. One railroad car axle 121 having a pair of wheels 123 with running surfaces 125 and a flange 127 are shown for illustration purposes. As shown in FIGS. 12 and 13, the running surfaces 103, 113, 125 engage while flange 127 resides in grooves 105, 115. Thus, as shown in FIG. 4, only three corners 131 on each of the four intersections 133 of railway crossing 21 receive wear and tear. The fourth and innermost corner 135 of each intersection 133 does not receive any wear.

The present invention has several advantages. The railway crossing of the present invention has a significantly longer operational life than prior art designs due to the segments being reversible. The inner segments may be interchangeably positioned with each other, and the outer segments may be interchangeably positioned with each other, such that the running surfaces and the unused guard surfaces may be switched at when needed. The railway crossing also has a plate with a pocket that defines a crossing angle for enabling one railway line to cross over another at virtually any angle. The pocket closely receives continuous long beams and divided beams, and has protrusions for restricting longitudinal horizontal movement of the beams. Each divided beam has three separate, discontinuous segments, including two outer segments and one inner segment. This design is much simpler to construct and assemble in the field. The fasteners used to secure the beams to the plate resist both vertical movement and lateral horizontal movement. Each fastener has a wedge brace, a clip, and a wedge. The wedge prevents pull-apart of the plate and the beams due to thermal forces, mechanical forces, and/or surface discontinuities.

While the invention has been shown or described in only some of its forms, it should be apparent to those skilled in the art that it is not so limited, but is susceptible to various changes without departing from the scope of the invention.

What is claimed is:

1. A railway crossing, comprising:

a plate having a plurality of plate segments and a pocket formed in the plate segments that defines a crossing angle, the pocket having a plurality of protrusions formed therein;

a pair of continuous long beams, each having a base seated in the pocket of the plate;

a pair of divided beams, each having three separate, discontinuous segments, and each of the segments having a base seated in the pocket in the plate and positioned at the crossing angle with respect to the long beams such that each of the segments abuts at least one of the long beams; and at least one recess formed in each of the bases of the long beams and in each of the bases of the segments of the divided beams, the recesses being complementary in shape to the protrusions in the pocket, such that engagement of the recesses by the protrusions resists movement of the long and divided beams along lengths thereof with respect to the plate;

fasteners for securing the long beams and the divided beams in the pocket of the plate; and wherein each of the fasteners comprises a rail brace assembly having a wedge brace joined to the plate, a clip joined to the wedge brace, and a wedge mounted between the wedge brace, the clip, and one of the long beams and the divided beams, such that the wedge prevents pull-apart of the plate, the long beams, and the divided beams due to thermal forces, mechanical forces, and surface discontinuities.

2. A railway crossing, comprising:

a plate;

a plurality of long beams mounted to the plate and having a longitudinal length and a lateral width that is transverse thereto;

a plurality of divided beams, each having a plurality of segments, mounted to the plate and positioned at a crossing angle with respect to the long beams, and each of the segments having a longitudinal length and a lateral width that is transverse thereto;

fasteners for securing the long beams and the divided beams to the plate and resisting both vertical movement and lateral horizontal movement of the long and divided beams with respect to the plate, each of the fasteners comprising a rail brace assembly having a wedge brace joined to the plate, a clip joined to the wedge brace, and a wedge mounted between the wedge brace, the clip, and one of the long beams and the divided beams, such that the wedge prevents pull-apart of the plate, the long beams, and the divided beams due to thermal forces, mechanical forces, and surface discontinuities; and the wedge brace has a receptacle formed therein with a tapered surface, each of the long beams and the segments of the divided beams has a tapered side wall, the wedge has a tapered knob that is complementary in shape to the receptacle and its tapered surface for engagement therewith, and the wedge has a tapered surface opposite the tapered knob that is complementary in shape to the tapered side walls for engagement therewith.

3. The railway crossing of claim 2, wherein the plate has a pocket formed therein for receiving the long beams and the divided beams.

4. The railway crossing of claim 3, the pocket has a plurality of protrusions formed therein, and each of the long beams and each of the divided beams has at least one recess that is complementary in shape to the protrusions in the pocket, such that engagement of the recesses by the protrusions resists movement of the long and divided beams along the longitudinal lengths thereof with respect to the plate.

5. The railway crossing of claim 2, wherein the longitudinal length of each of the segments of the divided beams is shorter than the longitudinal length of the long beams.

6. The railway crossing of claim 2, wherein the crossing angle is in the range of 40 degrees to 90 degrees.

7. The railway crossing of claim 2, wherein the segments of each of the divided beams comprise a pair of outer segments located outside of the long beams and in abutment with one of the long beams, and an inner segment located between the long beams and in abutment with all of the long beams.

8. The railway crossing of claim 7, wherein the longitudinal length of each of the inner segments is shorter than the longitudinal length of either of the outer segments, and wherein the outer segments are equal in length.

9. The railway crossing of claim 7, wherein the inner segments are reversible such that the inner segment of one of the divided beams may be interchangeably positioned with the inner segment of the other of the divided beams, and wherein the outer segments are reversible such that the outer segments of said one of the divided beams may be interchangeably positioned with the outer segments of said the other of the divided beams.

10. The railway crossing of claim 2, wherein the plate comprises a plurality of plate segments.

* * * * *

UNITED STATES PATENT AND TRADEMARK OFFICE

CERTIFICATE OF CORRECTION

PATENT NO. : 6,971,610 B2
APPLICATION NO. : 10/662787
DATED : December 6, 2005
INVENTOR(S) : Russell R. Hein et al.

It is certified that error appears in the above-identified patent and that said Letters Patent is hereby corrected as shown below:

On the title page:

Item (73) Assignee:

delete "General Electric Capital Corporation, Chicago IL (US)"

and insert therefor:

--Progress Rail Services Corporation, Albertville, AL (US)--

Signed and Sealed this

Second Day of October, 2007

JON W. DUDAS
*Director of the United States Patent and Trademark Office*